US011525617B2

(12) United States Patent
Swofford et al.

(10) Patent No.: US 11,525,617 B2
(45) Date of Patent: Dec. 13, 2022

(54) SYSTEMS AND METHODS FOR DEFROST LIGHTING IN REFRIGERATED CASES

(71) Applicant: Hill Phoenix, Inc., Conyers, GA (US)

(72) Inventors: Timothy Dean Swofford, Midlothian, VA (US); Neil John Rathje, South Chesterfield, VA (US)

(73) Assignee: Hill Phoenix, Inc., Conyers, GA (US)

( * ) Notice: Subject to any disclaimer, the term of this patent is extended or adjusted under 35 U.S.C. 154(b) by 162 days.

(21) Appl. No.: 16/601,870

(22) Filed: Oct. 15, 2019

(65) Prior Publication Data

US 2021/0108849 A1 Apr. 15, 2021

(51) Int. Cl.

| | |
|---|---|
| ***F25D 21/06*** | (2006.01) |
| ***A47F 3/04*** | (2006.01) |
| ***E05B 65/00*** | (2006.01) |
| ***F25D 27/00*** | (2006.01) |

(52) U.S. Cl.

CPC ..... *F25D 21/06* (2013.01); *A47F 3/043* (2013.01); *A47F 3/0478* (2013.01); *E05B 65/0042* (2013.01); *F25D 27/00* (2013.01); *F25D 2327/00* (2013.01)

(58) Field of Classification Search

CPC .. F25D 2327/00; F25D 2321/00; F25D 21/00; F25D 21/002; F25D 21/004; F25D 21/006; F25D 21/008; F25D 21/06; F25D 21/12; F25D 21/125; F25D 27/00; F25D 27/005; F25D 2700/02; E05B 65/0042; A47F 3/043; A47F 3/0478

See application file for complete search history.

(56) References Cited

U.S. PATENT DOCUMENTS

| | | | | |
|---|---|---|---|---|
| 6,477,853 | B1 * | 11/2002 | Khorram | A23L 3/28 62/177 |
| 9,157,675 | B2 | 10/2015 | Howington et al. | |
| 10,203,145 | B2 * | 2/2019 | Bates | F25D 23/069 |
| 10,588,429 | B2 | 3/2020 | Bates et al. | |
| 2006/0237427 | A1 * | 10/2006 | Logan | G07C 9/257 219/401 |

(Continued)

FOREIGN PATENT DOCUMENTS

| | | | | |
|---|---|---|---|---|
| JP | H-05060459 A | * | 3/1993 | F25D 27/00 |
| WO | WO-2008026137 A2 | * | 3/2008 | F25D 27/00 |
| WO | WO-2008155705 A1 | * | 12/2008 | F21V 5/04 |

*Primary Examiner* — Andrew M Roersma

(74) *Attorney, Agent, or Firm* — Fish & Richardson P.C.

(57) ABSTRACT

A refrigerated display case includes sidewalls, doors, shelves, a cooling system, a cooling coil defrost system, product defrost lights, and a controller. The sidewalls and doors may define an inner volume of the refrigerated display case. The shelves are positioned within the inner volume of the refrigerated display case, are fixedly coupled with at least one of the sidewalls, and are configured to support a product. The cooling system provides cooling to the inner volume of the refrigerated display case and may include a cooling coil. The cooling coil defrost system provides defrost heating to the cooling coil. Each of the product defrost lights are oriented towards a corresponding one of the shelves. The product defrost lights are configured to emit radiative heating for defrosting the product. The controller is operably coupled with the cooling system, the cooling coil defrost system, and the product defrost lights.

28 Claims, 6 Drawing Sheets

(56) References Cited

U.S. PATENT DOCUMENTS

| | | | | |
|---|---|---|---|---|
| 2008/0186695 | A1* | 8/2008 | Awai | G02B 6/001 362/92 |
| 2008/0186696 | A1* | 8/2008 | Awai | F25D 27/005 362/92 |
| 2008/0212314 | A1 | 9/2008 | Swofford et al. | |
| 2010/0180615 | A1* | 7/2010 | Linder | F25D 27/00 62/248 |
| 2015/0285552 | A1* | 10/2015 | Swaidan | F25D 23/12 62/80 |
| 2015/0342371 | A1* | 12/2015 | Leong | F25D 21/14 62/247 |
| 2018/0106524 | A1* | 4/2018 | Bates | F25D 17/045 |
| 2019/0008173 | A1* | 1/2019 | Park | F25D 29/00 |
| 2020/0003486 | A1* | 1/2020 | Kim | F25D 23/12 |
| 2020/0018451 | A1* | 1/2020 | Signorino | F21S 8/03 |

* cited by examiner

SYSTEMS AND METHODS FOR DEFROST LIGHTING IN REFRIGERATED CASES

BACKGROUND

The present disclosure generally relates to refrigerated display cases. More specifically, the present disclosure relates to defrosting operations for refrigerated display cases.

SUMMARY

One implementation of the present disclosure is a refrigerated display case, according to some embodiments. The refrigerated display case can include sidewalls, one or more doors, shelves, a cooling system, a cooling coil defrost system, product defrost lights, and a controller. The sidewalls and one or more doors may define an inner volume of the refrigerated display case. The shelves are positioned within the inner volume of the refrigerated display case, are fixedly coupled with at least one of the sidewalls, and are configured to support a product, according to some embodiments. The cooling system is configured to provide cooling to the inner volume of the refrigerated display case, according to some embodiments. The cooling system may include a cooling coil. The cooling coil defrost system is configured to provide defrost heating to the cooling coil. Each of the product defrost lights are oriented towards a corresponding one of the shelves, according to some embodiments. The product defrost lights are configured to emit radiative heating for defrosting the product. The controller is operably coupled with the cooling system, the cooling coil defrost system, and the one or more product defrost lights.

In some embodiments, the product defrost lights are infrared lights configured to emit infrared light energy towards the product to defrost the product.

In some embodiments, the product defrost lights are ultraviolet lights configured to emit ultraviolet light energy towards the product to defrost the product.

In some embodiments, the refrigerated display case further includes a door lock. The controller is operably coupled with the door lock and is configured to transition the door lock into a locked state before activating the product defrost lights.

In some embodiments, the controller is configured to operate the cooling system to provide the cooling to the inner volume of the refrigerated display case over a cooling interval. The controller may also be configured to operate the cooling coil defrost system to defrost the cooling coil over a defrost interval. The controller may also be configured to operate the one or more product defrost lights to defrost the product over a product defrost interval.

In some embodiments, the controller is configured to activate the one or more product defrost lights a predetermined amount of time after the defrost interval.

In some embodiments, the one or more product defrost lights are positioned along a mullion of the refrigerated display case.

Another implementation of the present disclosure is a refrigerated display case, according to some embodiments. In some embodiments, the refrigerated display case includes sidewalls, one or more doors, shelves, a cooling system, product defrost devices, and a controller. The sidewalls and the doors define an inner volume of the refrigerated display case, according to some embodiments. The shelves are positioned within the inner volume of the refrigerated display case, and are fixedly coupled with at least one of the sidewalls. The shelves are configured to support a product, according to some embodiments. The cooling system is configured to provide cooling to the inner volume of the refrigerated display case, according to some embodiments. The cooling system may include a cooling coil. Each product defrost device is oriented towards a corresponding one of the shelves, according to some embodiments. In some embodiments, the product defrost devices are configured to emit heating to the product to defrost the product. In some embodiments, the controller is operably coupled with the cooling system and the one or more product defrost devices.

In some embodiments, the product defrost devices are infrared lights configured to emit infrared light energy towards the product to defrost the product.

In some embodiments, the product defrost devices are ultraviolet lights configured to emit ultraviolet light energy towards the product to defrost the product.

In some embodiments, the product defrost devices are ultrasonic devices configured to emit ultrasonic energy towards the product to defrost the product.

In some embodiments, the refrigerated display case also includes a door lock. The controller may be operably coupled with the door lock and is configured to transition the door lock into a locked state before activating the product defrost lights.

In some embodiments, the controller is configured to operate the cooling system to provide the cooling to the inner volume of the refrigerated display case over a cooling interval. The controller may also be configured to operate a cooling coil defrost system to defrost the cooling coil over a defrost interval. The controller may also be configured to operate the one or more product defrost lights to defrost the product over a product defrost interval.

In some embodiments, the controller is configured to activate the one or more product defrost devices a predetermined amount of time after the defrost interval.

In some embodiments, the one or more product defrost devices are positioned along a mullion of the refrigerated display case.

Another implementation of the present disclosure is a method for defrosting products of a refrigerated display case, according to some embodiments. In some embodiments, the method includes operating a cooling system to provide cooling to an inner volume of the refrigerated display case over a cooling interval. The method can also include operating a cooling coil defrost system to provide defrost heating to a cooling coil of the cooling system over a defrost interval. The method can also include operating one or more product defrost lights to provide product defrost energy to a product in the refrigerated display case to defrost the product.

In some embodiments, the method further includes obtaining a door status of a door of the refrigerated display case. The method can also include operating a door lock of the refrigerated display case to transition into a locked state in response to the door status indicating that the door is closed. The method can also include activating the one or more product defrost lights to provide the product defrost energy to defrost the product in response to the door lock transitioning into the locked state.

In some embodiments, the one or more product defrost lights are activated after a predetermined amount of time since the defrost interval has elapsed.

In some embodiments, the one or more product defrost lights are ultraviolet lights configured to provide ultraviolet light energy to the product to defrost the product.

In some embodiments, the one or more product defrost lights are infrared lights configured to provide infrared light energy to the product to defrost the product.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Overview

Figure 1:
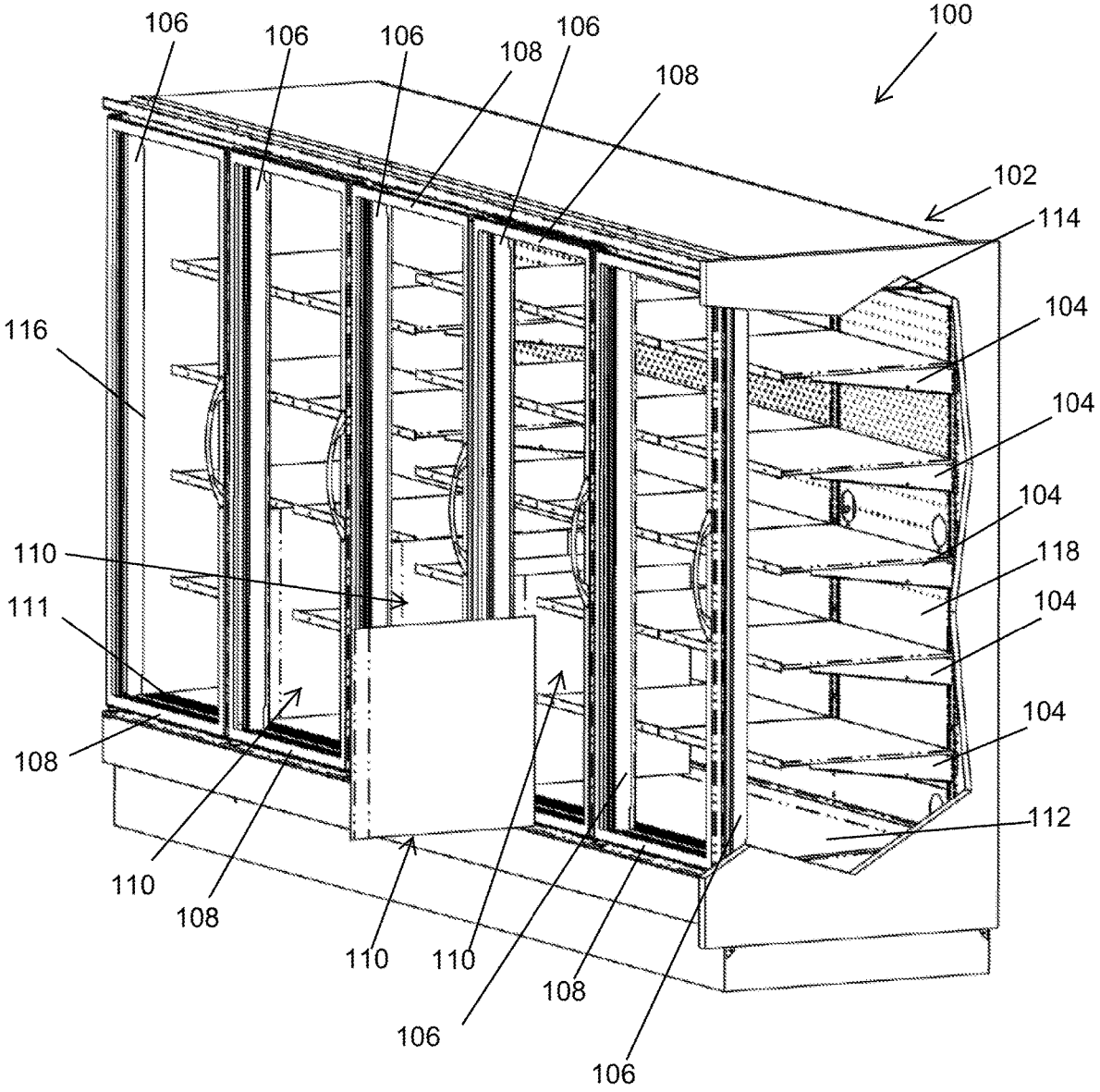
FIG. 1 is perspective, partially exploded view of a refrigerated display case including a number of lateral flow barriers, according to an exemplary embodiment.
Figure 2:
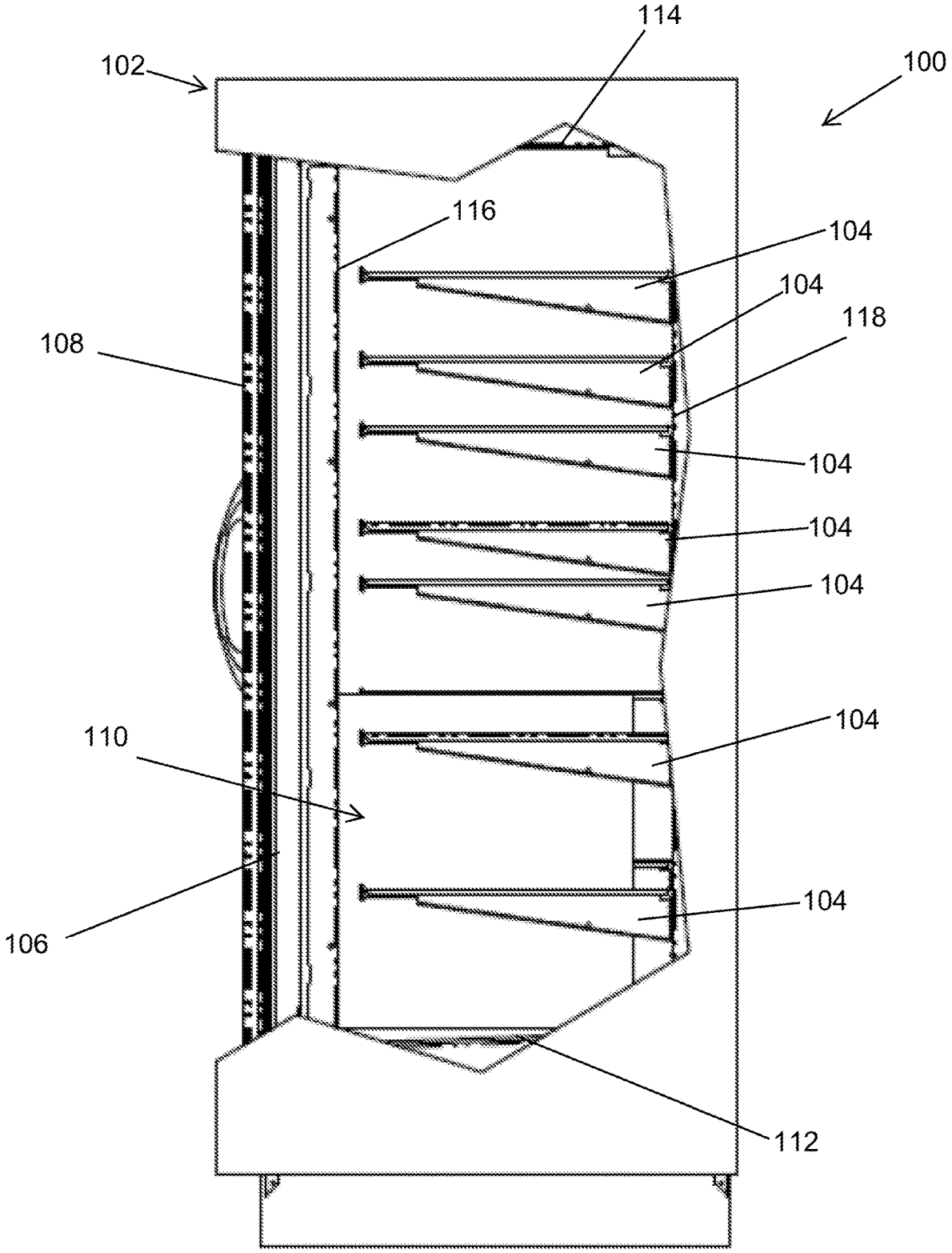
FIG. 2 is a cross-sectional view of the refrigerated display case shown in FIG. 1, according to an exemplary embodiment.
Figure 3:
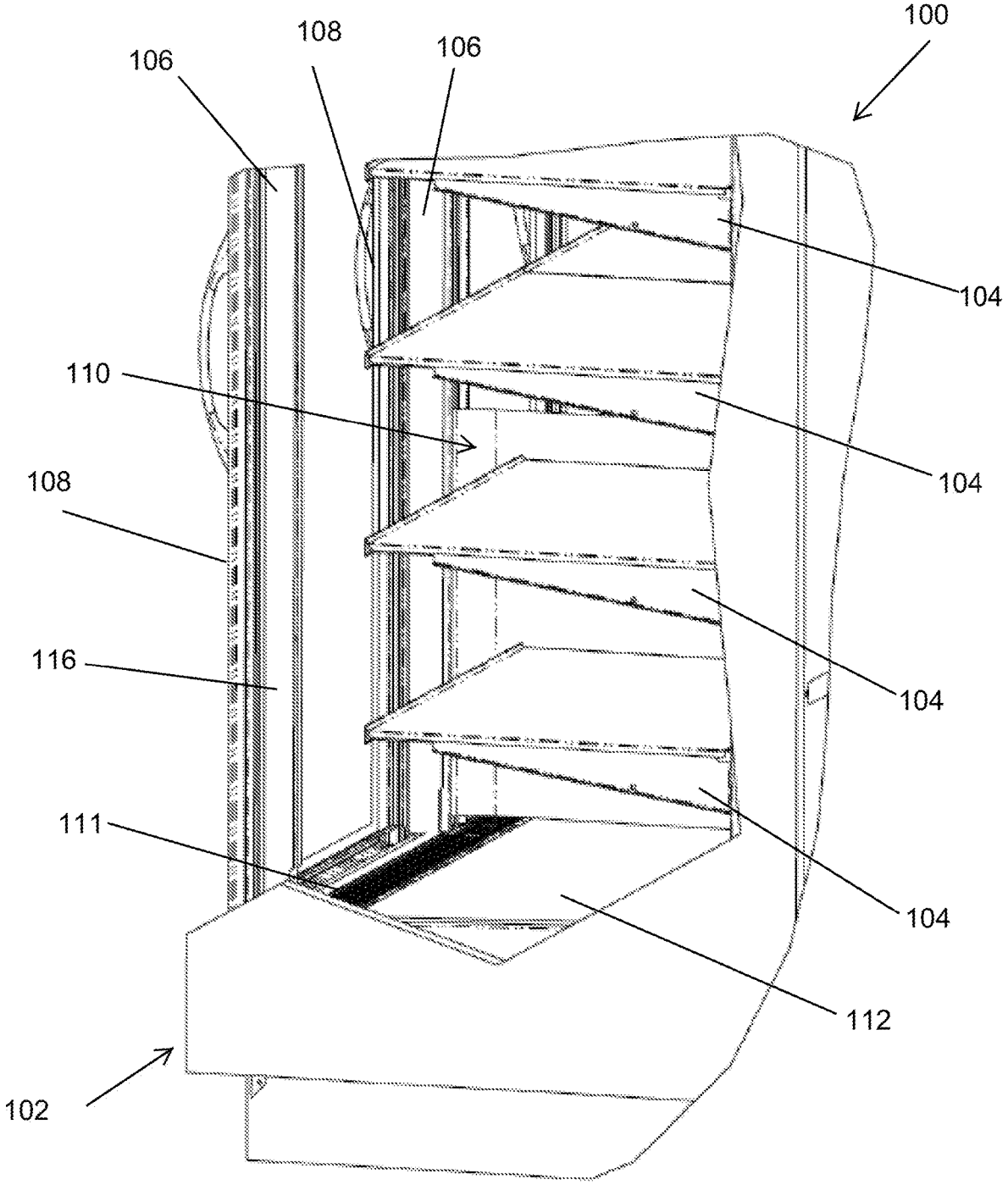
FIG. 3 is a perspective cross-sectional view of the refrigerated display case shown in FIG. 1, according to an exemplary embodiment.

Referring generally to the FIGURES, a refrigerated display case can include multiple sidewalls or panels and doors that define an inner volume. The refrigerated display case can include multiple shelves that support and store products. The refrigerated display case may include a cooling system, a cooling coil defrost system, and one or more product defrost mechanisms (e.g., ultraviolet lights, infrared lights, ultrasonic devices, etc.). The product defrost mechanisms may be configured to provide heating (e.g., radiative heating, ultrasonic waves, etc.) to the products to defrost or melt frost that can accumulate on the products. The refrigerated display case can include a controller that is configured to operate the cooling system, the cooling coil defrost system, and the product defrost mechanisms. The product defrost mechanisms may be activated in response to activating the cooling coil defrost system. The refrigerated display case can also include a door sensor and a lock that are operably and/or communicably coupled with the controller. The controller may be configured to transition the lock into a locked state prior to activating the product defrost mechanisms and can monitor a status or position of the doors based on sensor feedback received from the door sensor(s).

Refrigerated Display Case

Referring to FIGS. 1-4, a refrigerated display case 100, includes a frame (e.g., body, etc.) 102. In some embodiments, frame 102 includes at least one shelf (e.g., protrusion, flange, etc.) 104. Shelf 104 is configured to receive and support products (e.g., frozen goods, refrigerated goods, meats, cheeses, dairy, beverages, etc.) for display to a consumer (e.g., customer, etc.). Frame 102 includes a plurality of mullions (e.g., posts, columns, beams, etc.) 106 and at least one door (e.g., panel, etc.) 108. Frame 102 is configured such that mullions 106 are located on either side of doors 108. For example, when frame 102 includes two doors 108, frame 102 will include three mullions 106. In this way, mullions 106 may function as both hinge points for doors 108 and sealing surfaces for doors 108.

According to various embodiments, frame 102 is partitioned by mullions 106 such that various components of refrigerated display case 100 are modular. For example, shelves 104 may have a length that is approximately equal to a distance between mullions 106. This modularity allows refrigerated display case 100 to be adapted and tailored for a target application.

Refrigerated display case 100 can also include a plurality of lateral flow barriers (e.g., dividers, restrictors, preventers, reducers, impeders, panels, retainers, etc.) 110. Lateral flow barriers 110 are configured to impede (e.g., reduce, restrict, retain, substantially prevent, etc.) a certain amount of substantially lateral (e.g., left-right, right-left, etc.) flow of refrigerated air within refrigerated display case 100. According to various embodiments, each of the plurality of lateral flow barriers 110 is aligned with one of a plurality of mullions 106. In these embodiments, the number of mullions 106 is at least equal to the number of lateral flow barriers 110. According to an exemplary embodiment, lateral flow barriers 110 are coupled directly to the plurality of mullions 106. In this way, lateral flow barriers 110 are front-justified relative to frame 102. In an alternative embodiment, lateral flow barriers 110 are coupled to an air-curtain return 111 in frame 102.

According to an exemplary embodiment, in refrigerated display case 100, each door 108 is coupled to one mullion 106 as a hinge point and one mullion 106 as a sealing surface. At least one mullion 106 is coupled to lateral flow barrier 110 to at least partially define an first sub-compartment for at least one door 108 and at least one second sub-compartment for the at least one door 108. Lateral flow barriers 110 are configured to impede the flow of refrigerated air from within the at least one second sub-compartment into the first sub-compartment when the at least one door 108 is opened. Further, lateral flow barriers 110 are configured to impede ambient air from entering the at least one second sub-compartment when the at least one door 108 is opened.

Refrigerated display case 100 can include a top wall, a top panel, a top member, etc., shown as top panel 114. Refrigerated display case 100 can also include a rear wall, a rear panel, a rear member, etc., shown as rear panel 118, and a bottom wall, a bottom panel, a bottom member, etc., shown as bottom panel 112. Refrigerated display case 100 may also include side walls at opposite lateral ends of frame 102. Rear panel 118, the side walls, bottom panel 112, top panel 114, and doors 108 may define an inner volume, a space, a storage space, a storage area, a temperature controlled area, a cooled area, etc., shown as inner volume 126. Refrigerated display case 100 can include a cooling system 123 including a cooling coil 124 (e.g., proximate bottom panel 112) and a plenum 122. Cooling coil 124 and plenum 122 can be configured to provide cooling to inner volume 126 of refrigerated display case 100. Cooling coil 124 and plenum 122 can be configured to circulate air through refrigerated display case 100 to maintain a temperature within refrigerated display case 100 below a certain value or at the certain value. Cooling coil 124 and plenum 122 may drive air to circulate upwards along rear panel 118, and downwards along doors 108.

Figure 4:
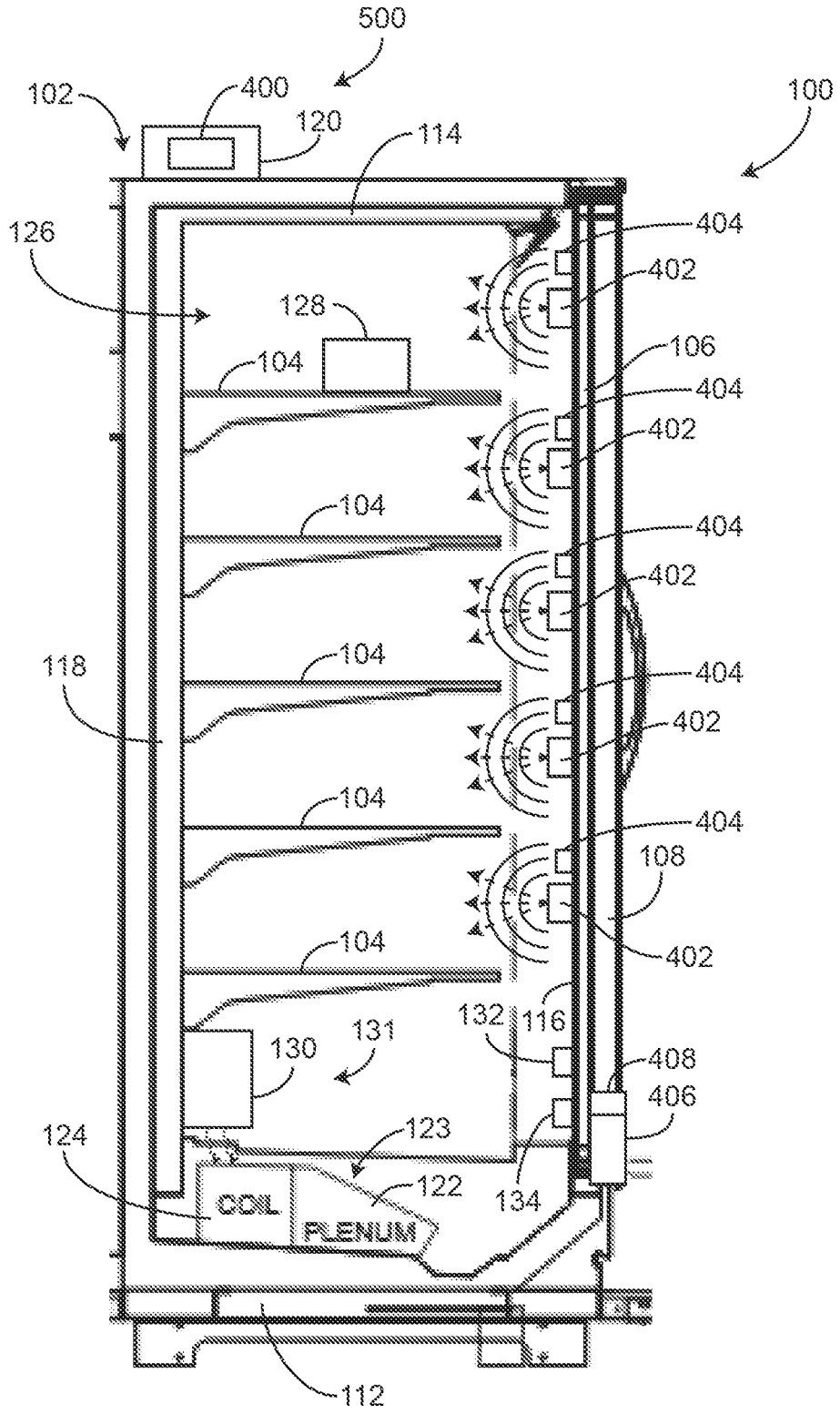
FIG. 4 is a cross-sectional view of the refrigerated display case shown in FIG. 1, including one or more defrost lights, according an exemplary embodiment.

Referring particularly to FIG. 4, refrigerated display case 100 can include a temperature sensor 132 and/or a humidity sensor 134. Temperature sensor 132 can be configured to measure a temperature within inner volume 126 of refrigerated display case 100. Humidity sensor 134 can be configured to measure a humidity or a relative humidity within inner volume 126. The temperature as measured by temperature sensor 132 and/or the humidity as measured by humidity sensor 134 can be used to operate cooling coil 124 and/or plenum 122 to maintain the temperature and/or humidity within inner volume 126 at desired values.

Cooling system 123 can be configured similarly to or the same as the cooling system described in greater detail with reference to U.S. application Ser. No. 15/293,958, filed Oct. 14, 2016, the entire disclosure of which is incorporated by reference herein. It should be understood that the refrigerated display case 100 as described herein may share any of the features, components, configuration, functionality, control systems, etc., of the temperature-controlled display device described in U.S. application Ser. No. 15/293,958.

Referring still to FIG. 4, refrigerated display case 100 can include multiple defrost lights, defrosting devices, product defrost devices, etc., shown as defrost lights 402. In some embodiments, refrigerated display case 100 includes one or more defrost lights 402 associated with or corresponding to each shelf 104. Defrost lights 402 can be positioned along and fixedly coupled with mullion 106. For example, defrost lights 402 may be fixedly coupled with an interior or inwards facing surface 116 of mullion 106. Defrost lights 402 are configured to provide heating (e.g., radiative heating) to products 128 that are positioned on or rest upon shelf 104. For example, defrost lights 402 can be oriented or directed towards corresponding products 128 or corresponding ones of shelves 104 so that light emitted by defrost lights 402 contacts or is emitted onto products 128, thereby defrosting products 128. Defrost lights 402 can melt or defrost surfaces of products 128 that receive the light emitted by defrost lights 402. Advantageously, defrost lights 402 can reduce frost which may accumulate on products 128, thereby improving a customer's experience while selecting and viewing products 128.

Products 128 can accumulate frost due to moisture present in the air in inner volume 126. Moisture may be introduced into inner volume 126 when doors 108 are opened (e.g., by customers or workers) to access inner volume 126. When doors 108 are opened, warm and/or moist air may enter inner volume 126, thereby increasing the humidity within inner volume 126. Moisture can also be present in inner volume 126 due to products 128 or due to leaks in the refrigerated display case 100. When the temperature within refrigerated display case 100 is decreased (e.g., due to cooling operations of cooling system 123), the moisture may collect and freeze on products 128, thereby resulting in frosty products 128. The moisture may also collect and freeze on doors 108 or on windows of refrigerated display case 100.

Refrigerated display case 100 can also include various lights, light emitting devices, etc., shown as display lights 404. Display lights 404 can be configured to provide illumination or lighting to inner volume 126 of refrigerated display case 100. Display lights 404 may be configured to provide display lighting for products 128 inside refrigerated display case 100 so that products 128 are visible to customers. Display lights 404 can be light emitting diodes (LEDs), incandescent lights, etc., or any other light emitting device.

Display lights 404 can be positioned along or integrated with mullion 106. For example, display lights 404 can be integrated into a lighting fixture that extends along mullion 106. The lighting fixture may also be positioned along a bottom edge of doors 108 or along a frame or rail member that extends between the sidewalls of refrigerated display case 100. Display lights 404 may be activated by a motion sensor that is configured to detect motion past in front of refrigerated display case 100 (e.g., exterior motion). For example, when the motion sensor detects that a person is proximate and outside of refrigerated display case 100, display lights 404 may activate to provide display lighting to inner volume 126 of refrigerated display case 100.

Defrost lights 402 can be integrated into the same lighting fixture or lighting structure of display lights 404. For example, defrost lights 402 may be adjacent display lights 402 but separate from display lights 402. In this way, display lights 402 can provide display lighting to products 128, while defrost lights 402 provide defrost heating to products 128. In some embodiments, display lights 404 emit light that is within the visible spectrum for illumination while defrost lights 402 emit light that is outside of the visible spectrum for defrosting. Defrost lights 404 can be separate from, and/or in addition to display lights 402 that are used for illumination lighting.

Refrigerated display case 100 may include a door lock 406 and a door sensor 408. Door sensor 408 can be a rotary potentiometer, a linear potentiometer, a distance sensor, a button, a switch, etc., that is configured to detect if doors 108 are closed. In some embodiments, each door 108 includes a corresponding at least one door sensor 408. Door sensor 408 can be positioned along a frame of door 108, or may be integrated into frame 102 of refrigerated display case 100. For example, if door sensor 408 is a button or a switch, door sensor 408 can be positioned on door 108 at a position such that the button or switch is depressed when door 108 is fully closed. In another example, if door sensor 408 is a button or a switch, door sensor 408 can be positioned on a portion of refrigerated display case 100 that is stationary relative to door 108. When door 108 is fully closed, the button may be depressed (e.g., positioned between a stationary portion of refrigerated display case 100 and a movable portion of door 108). If door sensor 408 is a rotary potentiometer, door sensor 408 can be positioned at a hinge of door 108 and may detect or measure a rotational or angular position of door 108.

Door lock 406 can be configured to transition between a locked state and an unlocked state. When door lock 406 is in the locked state, door 108 is prevented from being opened. In some embodiments, door lock 406 is only transitioned into the locked state when door 108 is in the closed position (e.g., as shown in FIG. 4). Door lock 406 may transition into the unlocked state so that door 108 can be opened (e.g., by a customer). In some embodiments, door lock 406 is transitioned into the locked state when defrost lights 402 are activated and/or while defrost lights 402 are in an active state (e.g., to emit radiative heating to products 128 and/or the inner volume 126). Once a defrost cycle has been completed (e.g., after defrost lights 402 have been activated for a predetermined amount of time or have remained in the active state for the predetermined amount of time), door lock 406 may transition into the unlocked state so that doors 108 can be opened and products 128 (or inner volume 126) are accessible.

Defrost lights 402 can be ultraviolet or infrared lights that are configured to emit light (e.g., light that is outside of the visible spectrum) to defrost products 128 and/or shelves 104. It should be understood that defrost lights 402 can be configured to provide light energy to products 128 and/or shelves 104 at any wavelength capable of transmitting sufficient energy to heat or melt frost. In some embodiments, defrost lights 402 are or include ultrasonic devices. It should be understood that while in some embodiments, defrost lights 402 are light emitting devices, defrost lights 402 may be more generally referred to as "defrost mechanisms" and are not limited to only light emitting devices. If defrost mechanisms 402 are ultrasonic devices, defrost mechanisms 402 can be configured to emit ultrasonic waves towards products 128 and/or shelves 104 to melt frost that is present on products 128 and/or shelves 104.

Referring still to FIG. 4, refrigerated display case 100 includes a defrost system 131 that is configured to provide heating to cooling coil 124 to melt frost that can accumulate on cooling coil 124. In some embodiments, defrost system 131 includes a heater 130 that is configured to provide heating to cooling coil 124. Heater 130 can be a resistive heater, a conductive heater, a convective heater, a radiative heater, etc., or any other heater that can be configured to deliver hear to cooling coil 124 for defrosting purposes.

Referring still to FIG. 4, the refrigerated display case 100 can include a control system 500. Control system 500 includes a controller 400 that is configured to receive sensor information or data (e.g., sensor signals) from any of the sensors of refrigerated display case 100 (e.g., from door sensor 408, temperature sensor 132, humidity sensor 134, the motion sensor, etc.). Controller 400 can be positioned within a housing 120 that is positioned and/or fixedly coupled on refrigerated display case 100. Housing 120 can be fixedly coupled with frame 102 of refrigerated display case 100. Housing 120 may be integrated with any of the walls, panels, etc., of refrigerated display case 100. In some embodiments, housing 120 is positioned within inner volume 126, while in other embodiments, housing 120 is positioned outside of inner volume 126.

Controller 400 is configured to generate control signals or operate any of the components, systems, devices, etc., of refrigerated display case 100. For example, controller 400 can be configured to generate control signals for door lock 406, cooling system 123, display lights 404, defrost lights 402, defrost system 131, etc.

Control System and Controller

Figure 5:
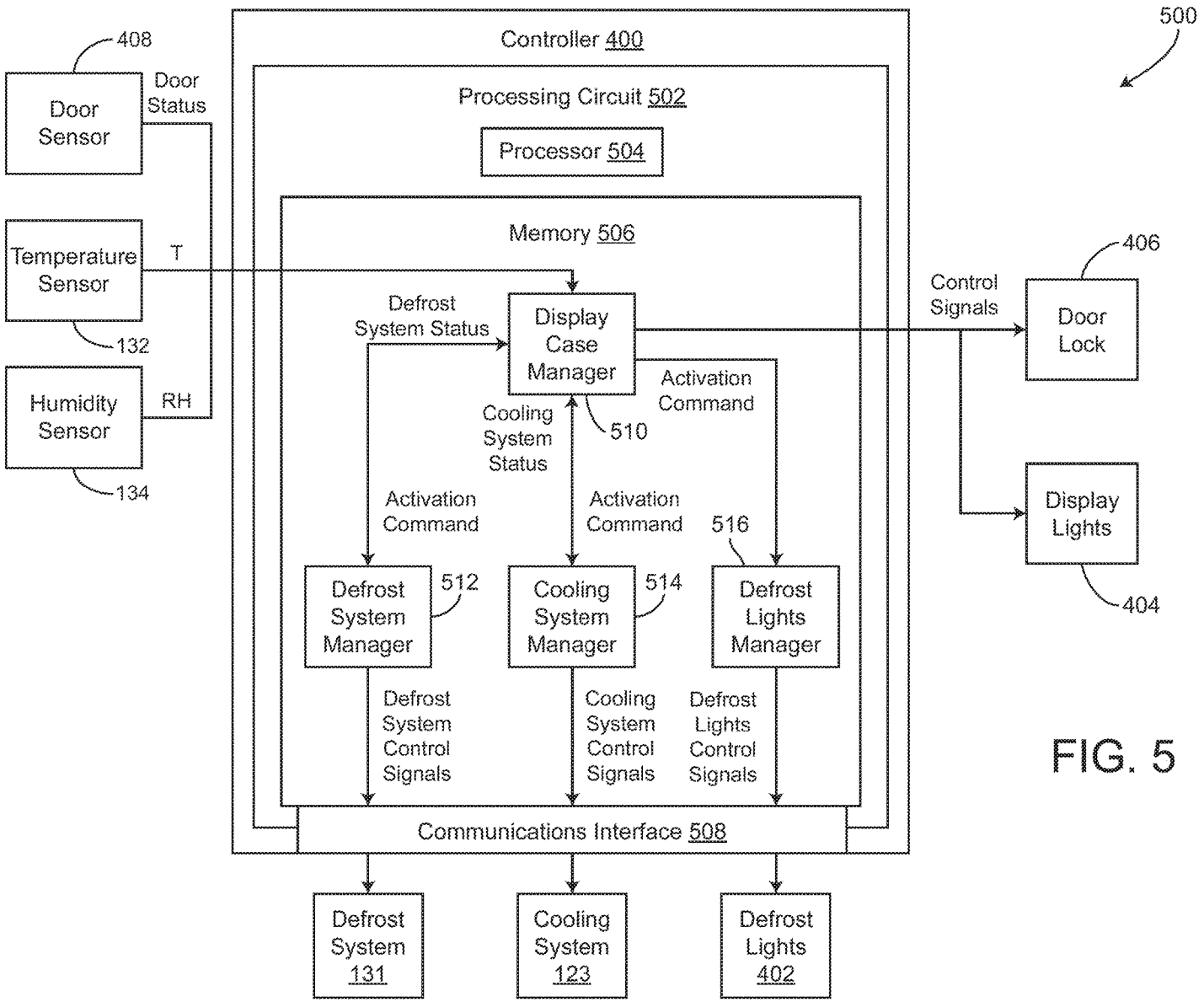
FIG. 5 is a block diagram of a control system for operating the defrost lights of the refrigerated display case shown in FIG. 4, according to an exemplary embodiment.

Referring particularly to FIG. 5, control system 500 and controller 400 are shown in greater detail, according to some embodiments. Control system 500 includes controller 400, door sensor 408, temperature sensor 132, humidity sensor 134, door lock 406, display lights 404, defrost system 131, cooling system 123, and defrost lights 402. Controller 400 can include a communications interface 508. Communications interface 508 may facilitate communications between controller 400 and external systems, devices, sensors, etc. (e.g., a user interface, door sensor 408, temperature sensor 132, humidity sensor 134, defrost system 131, cooling system 123, defrost lights 402, door lock 406, display lights 404, etc.) for allowing control, monitoring, and adjustment to any of the communicably connected devices, sensors, systems, heaters, etc. Communications interface 508 may also facilitate communications between controller 400 and a human machine interface (e.g., a user interface).

Communications interface 508 can be or include wired or wireless communications interfaces (e.g., jacks, antennas, transmitters, receivers, transceivers, wire terminals, etc.) for conducting data communications with sensors, devices, systems, etc., of control system 500 or other external systems or devices (e.g., a user interface, one or more components, devices, sensors, etc., of refrigerated display device 100, etc.). In various embodiments, communications via communications interface 508 can be direct (e.g., local wired or wireless communications) or via a communications network (e.g., a WAN, the Internet, a cellular network, etc.). For example, communications interface 508 can include an Ethernet card and port for sending and receiving data via an Ethernet-based communications link or network. In another example, communications interface 508 can include a Wi-Fi transceiver for communicating via a wireless communications network. In some embodiments, the communications interface is or includes a power line communications interface. In other embodiments, the communications interface is or includes an Ethernet interface, a USB interface, a serial communications interface, a parallel communications interface, etc.

Controller 400 includes a processing circuit 502, a processor 504, and memory 506, according to some embodiments. Processing circuit 502 can be communicably connected to communications interface 508 such that processing circuit 502 and the various components thereof can send and receive data via the communications interface. Processor 504 can be implemented as a general purpose processor, an application specific integrated circuit (ASIC), one or more field programmable gate arrays (FPGAs), a group of processing components, or other suitable electronic processing components.

Memory 506 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 506 can be or include volatile memory or non-volatile memory. Memory 506 can include database components, object code components, script components, or any other type of information structure for supporting the various activities and information structures described in the present application. According to some embodiments, memory 506 is communicably connected to processor 504 via processing circuit 502 and includes computer code for executing (e.g., by processing circuit 502 and/or processor 504) one or more processes described herein.

Memory 506 includes a display case manager 510, a defrost system manager 512, a cooling system manager 514, and a defrost manager 516. Display case manager 510 is configured to receive a measured temperature T from temperature sensor 132, a door status from door sensor 408, and relative humidity RH from humidity sensor 134. Display case manager 510 is configured to provide activation commands and/or control signals to any of defrost system manager 512, cooling system manager 514, defrost lights manager 516, door lock 406, and display lights 404. For example, display case manager 510 can be configured to provide activation signals to defrost system manager 512, cooling system manager 514, and defrost lights manager 516 to cause managers 512-516 to perform their respective functions (e.g., to operate their respective systems or devices).

Cooling system manager 514 is configured to receive the activation command from display case manager 510 and generate cooling system control signals for cooling system 123. For example, cooling system manager 514 can generate control signals for cooling coil 124 and/or a fan of cooling system 123 so that cooling system 123 operates to provide cooling to inner volume 126 of refrigerated display case 100. Cooling system manager 514 can generate the control signals for cooling system 123 to operate cooling system 123 according to a cooling cycle. For example, cooling coil 124 and/or the fan of cooling system 123 may operate according to predetermined parameters (e.g., a predetermined fan speed, predetermined coolant setpoint temperatures, etc.) to provide a desired rate of cooling to inner volume 126. In some embodiments, the fan speed of cooling system 123 is operated or controlled by cooling system manager 514 and/or display case manager 510 using feedback from temperature sensor 132. For example, cooling system manager 514 can use the temperature T received from temperature sensor 132 as feedback data (e.g., in a PI control scheme, a PID control scheme, etc.) to drive the temperature T in the inner volume 126 towards a setpoint temperature $T_{sp}$ or to maintain the temperature T at the setpoint temperature $T_{sp}$.

Cooling system manager 514 may operate cooling system 123 according to a predetermined cooling cycle. In some embodiments, cooling system manager 514 operates cooling system 123 in various intervals so that cooling is provided to inner volume 126 periodically during cooling cycles. In other embodiments, cooling system manager 514 operates cooling system 123 continuously and deactivates at predetermined or scheduled times (e.g., scheduled times of day) to defrost cooling coil 124. In some embodiments, frost is detected on cooling coil 124 using sensor feedback. Cooling system manager 514 may operate cooling system 123 continuously until frost or condensation is detected on cooling coil 124 (e.g., once the sensor detects frost on cooling coil 124).

Cooling system manager 514 may also provide display case manager 510 with an indication of an operational status of cooling system 123. For example, if cooling system 123 is currently being operated by cooling system manager 514 (e.g., if cooling system 123 is performing a cooling cycle), cooling system manager 514 can provide display case manager 510 with an indication that cooling system 123 is currently active (e.g., is activated) or that cooling system 123 is currently operating to provide cooling to inner volume 126 of refrigerated display case 100. Display case manager 510 may use the operational status of cooling system 123 to activate defrost system manager 512 and/or to activate defrost lights manager 516.

Referring still to FIG. 5, defrost system manager 512 is configured to generate control signals for defrost system 131 to provide defrost heating to cooling coil 124. In some embodiments, defrost system manager 512 is configured to receive the activation command from display case manager 510 and operate defrost system 131 to provide defrost heating to cooling coil 124 in response to receiving the activation command. Defrost system manager 512 may generate defrost system control signals for defrost system 131 and provide the defrost system control signals to defrost system 131 so that heater 130 operates to provide defrost heating to cooling coils 124. Defrost system manager 512 may operate defrost system 131 for a predetermined amount of time so that the defrost heating is provided to cooling coils 124. In some embodiments, the predetermined amount of time that defrost system 131 is operated for is an amount of time sufficient to melt frost present on cooling coils 124. In some embodiments, defrost system manager 512 operates defrost system manager 131 based on sensor feedback. For example defrost system manager 512 can operate defrost system 131 until an optical sensor or a cooling coil sensor indicates that there is no more frost on cooling coils 124 or until the sensor indicates that a negligible amount of frost is present on cooling coils 124. In this way, defrost system manager 512 may operate defrost system 131 using an open loop control scheme (e.g., operating defrost system 131 for a predetermined amount of time) or using a closed loop control scheme (e.g., based on sensor feedback that indicates whether or not frost is present on cooling coils 124).

In some embodiments, defrost system manager 512 is also configured to provide display case manager 510 with an indication of an operational status of defrost system 131. For example, defrost system manager 512 can provide display case manager 510 with an indication that defrost system 131 is currently active (e.g., that defrost system 131 is operating to provide defrost heating to cooling coils 124) or that defrost system 131 is inactive (e.g., that defrost system 131 is not operating to provide defrost heating to cooling coils 124, that a defrost cycle has ended, etc.). Display case manager 510 can use the operational status of defrost system 131 to determine when to activate defrost lights manager 516.

Defrost lights manager 516 is configured to receive the activation command from display case manager 510 and activate or operate defrost lights 402 in response to receiving the activation command from display case manager 510. Defrost lights manager 516 may activate defrost lights 402 to provide heating to products 128 in response to receiving the activation command from display case manager 510. Defrost lights manager 516 can operate defrost lights 402 for a predetermined amount of time to melt frost on products 128 or to otherwise reduce frost on products 128. Defrost lights manager 516 can be configured to generate control signals for infrared lights, ultraviolet lights, ultrasonic devices, etc., that are configured to reduce frost on products 128. In some embodiments, defrost lights 404 are activated at predetermined or scheduled times of day. For example, defrost lights 404 may be activated at night time according to a schedule, at a particular time of day when customer activity is expected to be low, etc. In this way, defrost system manager 512 can store and operate according to a schedule to activate defrost system 131, cooling system 123, and/or defrost lights 402 by providing the activation commands to defrost system manager 512, cooling system manager 514, and/or defrost lights manager 516, respectively.

Referring still to FIG. 5, display case manager 510 is configured to operate door lock 406, according to some embodiments. In some embodiments, display case manager 510 is configured to provide control signals to door lock 406 to lock doors 108 while defrost lights 402 are activated. For example, if defrost lights 402 are activated and operate for a 15 minute cycle, display case manager 510 can transition door lock 406 into the locked state prior to activating defrost lights 402 (e.g., concurrently with or prior to providing the activation command to defrost lights manager 516). In this way, doors 108 may be maintained in the locked state so that inner volume 126 is inaccessible to customers or users while defrost lights 402 are operated.

Display case manager 510 may provide the activation command to defrost lights manager 516 to activate defrost lights 402 only if doors 108 are closed. For example, display case manager 510 may receive the door status from door sensor 408 and determine whether or not doors 108 are currently closed. If doors 108 are closed, display case manager 510 can generate the control signals for door lock 406 to lock doors 108. After doors 108 are locked, display case manager 510 can provide the activation command to defrost lights manager 516.

Display case manager 510 may sequentially provide the activation commands to defrost system manager 512, cooling system manager 514, and defrost lights manager 516. For example, display case manager 510 may provide the activation commands to cooling system manager 514, defrost system manager 512, and defrost lights manager 516 according to a schedule. Display case manager 510 may provide the activation command to cooling system manager 514 so that cooling system 123 operates over a scheduled cooling interval (or until frost is detected on cooling coils 124). After the cooling interval is completed, display case manager 510 may provide a shut-down, de-activation, or standby command to cooling system manager 514. After the cooling interval is completed, display case manager 510 can transition refrigerated display case 100 into a coil defrost mode. Display case manager 510 can provide the activation command to defrost system manager 512 to transition display case 100 into the coil defrost mode. In some embodiments, display case manager 510 also provides the activation command to defrost lights manager 516 concurrently with providing the activation command to cooling system manager 514. In this way, display case manager 510 can activate both cooling system 123 and defrost lights 402 so that cooling coils 124 and products 128 are de-frosted at least partially concurrently.

In other embodiments, display case manager 510 provides the activation command to defrost lights manager 516 after defrost system 131 has finished defrosting cooling coils 124. In some embodiments, display case manager 510 provides the activation command to defrost lights manager 516 a predetermined amount of time (e.g., 5 minutes, 10 minutes, 15 minutes, etc.) after defrost system 131 has completed a defrost cycle.

Referring still to FIG. 5, display case manager 510 is configured to generate and provide control signals to display lights 404, according to some embodiments. In some embodiments, display case manager 510 is configured to receive sensor feedback from a motion detector or a proximity detector and operate display lights 404 based on the sensor feedback. For example, display case manager 510 can operate display lights 404 to activate in response to receiving sensor feedback that indicates that a customer or user is proximate refrigerated display case 100.

Defrost Lights Process

Figure 6:
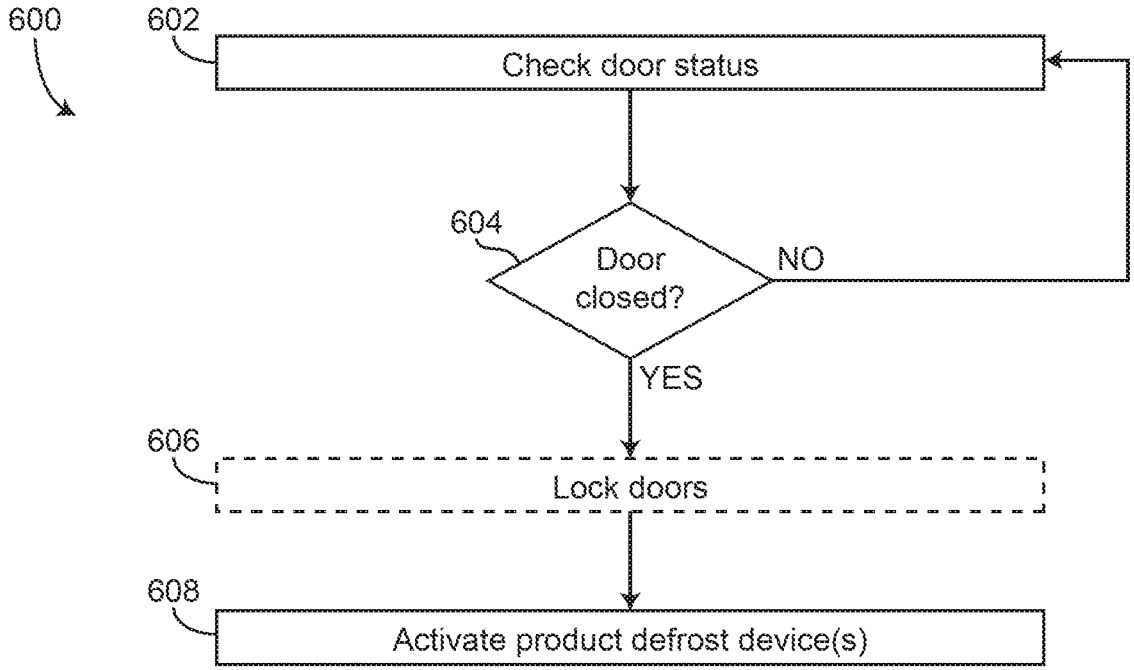
FIG. 6 is a flow diagram of a process for operating the defrost lights of the refrigerated display case of FIG. 4, according to an exemplary embodiment.

Referring particularly to FIG. 6, a process 600 for operating defrost lights or defrost mechanisms of a refrigerated display case is shown, according to some embodiments. Process 600 includes steps 602-608 and can be performed by controller 400. Specifically, process 600 can be performed by display case manager 510 and defrost lights manager 516.

Process 600 includes checking a door status (step 602), according to some embodiments. In some embodiments, the door status is obtained by display case manager 510. Display case manager 510 may receive the door status from door sensor 408 that is configured to monitor a position or state of door 108.

Process 600 also includes determining if the door is closed (step 604), according to some embodiments. In some embodiments, step 604 is performed by display case manager 510 of controller 400. Display case manager 510 can monitor sensor signals received from door sensor 408 and can determine if door 108 is open or closed based on the sensor signals. If door 108 is open (step 604, "NO"), process 600 returns to step 602 and waits until door 108 is closed. If door 108 is closed (step 604, "YES"), process 600 proceeds to step 606.

Process 600 includes transitioning doors into a locked state (step 606), according to some embodiments. In some embodiments, step 606 is optional. In some embodiments, step 606 is performed by display case manager 510 and door lock 406. For example, controller 400 can be operably coupled with door lock 406 so that door lock 406 is transitionable between the locked state and the unlocked state. Display case manager 510 can generate control signals for door lock 406 in response to detecting that door 108 is closed (e.g., in response to step 604, "YES"). Display case manager 510 may generate control signals for any of the door locks 406 of the refrigerated display case 100 to ensure that display case 100 is inaccessible once defrost lights 402 are activated. In some embodiments, step 606 includes prompting a user to manually lock door 108.

Process 600 includes activating defrost device(s) (step 608), according to some embodiments. In some embodiments, the defrost device(s) are ultrasonic devices that are configured to provide ultrasonic waves or energy to products or shelves of the refrigerated display case. In other embodiments, the defrost device(s) (e.g., defrost lights 402) are ultraviolet or infrared light emitting devices. Step 608 can include providing defrost lights manager 516 with an activation command so that defrost lights manager 516 activates defrost lights 502 to provide heat (e.g. radiative heat) to products 128.

Cooling, Coil Defrost, and Product Defrost Process

Figure 7:
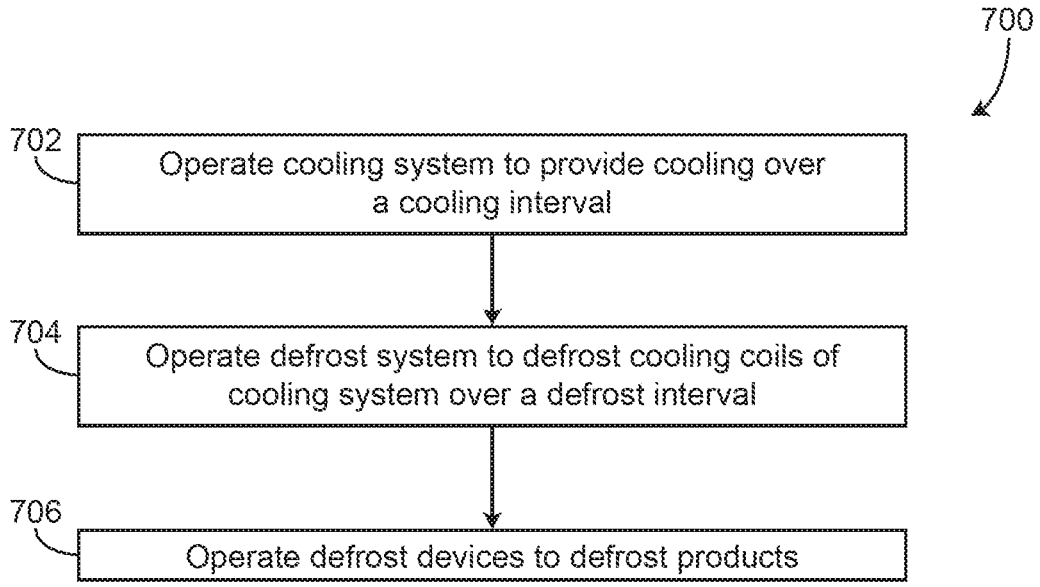
FIG. 7 is a flow diagram of a process for operating a cooling system, a cooling coil defrost system, and product defrost devices of the refrigerated display case of FIG. 4, according to an exemplary embodiment.

Referring particularly to FIG. 7, a process 700 for operating a cooling system, a defrost system, and product defrost devices of a refrigerated display case is shown, according to some embodiments. Process 700 include steps 702-706 and can be performed by controller 400. Controller 400 may be configured to operate defrost system 131, cooling system 123, and defrost lights 402 to provide cooling, coil defrost operations, and product defrost operations.

Process 700 includes operating a cooling system to provide cooling to the refrigerated display case (step 702), according to some embodiments. In some embodiments, step 702 is performed by display case manager 510 and cooling system manager 514. For example, display case manager 510 can provide an activation command to cooling system manager 514 to activate cooling system 123 over a scheduled cooling interval. Cooling system manager 514 operates cooling system 123 so that heat is removed from an inner volume of the refrigerated display case.

Process 700 includes operating a defrost system to defrost cooling coils of the cooling system over a defrost interval (step 704), according to some embodiments. In some embodiments, step 704 is performed by display case manager 510 and defrost system manager 512. Display case manager 510 can provide defrost system manager 512 with an activation command at or over a scheduled defrost interval so that defrost system 131 operates to defrost or melt frost on cooling coils 124 of cooling system 123. In some embodiments, step 704 is performed in response to completion of the cooling operations of step 702. For example, step 704 may be performed after cooling system 123 has finished cooling the refrigerated display case and/or after cooling system 123 has transitioned into an inactive or standby state.

Process 700 includes operating defrost devices (e.g., defrost lights 402) to defrost or provide heat (e.g., radiative heat) to products (e.g., products 128) of the refrigerated display case (step 706), according to some embodiments. In some embodiments, step 706 is performed by display case manager 510 and defrost system manager 512. Step 706 can include providing an activation command to defrost lights manager 516. In some embodiments, step 706 is performed concurrently with step 704. In other embodiments, step 706 is performed (e.g., defrost lights 402 are activated) after a predetermined amount of time (e.g., 5 minutes, 10 minutes, etc.) has passed since completing step 704 (e.g., after defrost system 131 has completed its respective coil defrost operations). In some embodiments, step 706 is performed after a predetermined amount of time has passed since step 704 is initiated.

Configuration of Exemplary Embodiments

The construction and arrangement of the temperature-controlled display device as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "first", "second", "primary," "secondary," "above," "below," "between," etc.) are merely used to describe the orientation of various elements in the FIGURES. It should be noted that the orientation of various elements may differ according to other exemplary embodiments, and that such variations are intended to be encompassed by the present disclosure.

The present disclosure contemplates methods, systems and program products on memory or other machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products or memory including machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the FIGURES may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A refrigerated display case comprising:

a plurality of sidewalls and one or more doors, the plurality of sidewalls and the one or more doors defining an inner volume of the refrigerated display case, at least one of the doors comprising a door lock configured to transition between a locked state in which the at least one door is prevented from opening and the inner volume is inaccessible and an unlocked state in which the at least one door is openable and the inner volume is accessible;

a plurality of shelves positioned within the inner volume of the refrigerated display case, the plurality of shelves fixedly coupled with at least one sidewall of the plurality of sidewalls and are configured to support a product;

a cooling system configured to provide cooling to the inner volume of the refrigerated display case, the cooling system comprising a cooling coil;

a cooling coil defrost system configured to provide defrost heating to the cooling coil;

one or more product defrost lights, each of the one or more product defrost lights oriented towards a corresponding shelf of the plurality of shelves, the product defrost lights configured to emit light outside of a visible spectrum to provide radiative heating to melt frost from, or defrost, a surface of the product;

one or more display lights separate from the one or more product defrost lights, integrated into a lighting structure that comprises the one or more product defrost lights, and oriented towards the corresponding shelf of the plurality of shelves, the one or more display lights configured to emit light within the visible spectrum towards the corresponding shelf; and a controller operably coupled with the cooling system, the cooling coil defrost system, the one or more display lights, the one or more product defrost lights, and the at least one door, the controller configured to perform operations comprising:

determining a door status of the at least one door;

based on the determined door status, transitioning the door lock of the at least one door to the locked state; and subsequent to the transitioning, activating the one or more product defrost lights while maintaining the inner volume as inaccessible with the door lock in the locked state.

2. The refrigerated display case of claim 1, wherein the product defrost lights are infrared lights configured to emit infrared light energy towards the product to defrost the product.

3. The refrigerated display case of claim 1, wherein the product defrost lights are ultraviolet lights configured to emit ultraviolet light energy towards the product to defrost the product.

4. The refrigerated display case of claim 1, wherein the controller is configured to perform operations comprising:

determining that the one or more product defrost lights have switched from activated to inactive; and based on the determination, transitioning the door lock of the at least one door to the unlocked state.

5. The refrigerated display case of claim 1, wherein the controller is configured to:

operate the cooling system to provide the cooling to the inner volume of the refrigerated display case over a cooling interval;

operate the cooling coil defrost system to defrost the cooling coil over a defrost interval; and operate the one or more product defrost lights to defrost the product over a product defrost interval.

6. The refrigerated display case of claim 5, wherein the controller is configured to activate the one or more product defrost lights a predetermined amount of time after the defrost interval.

7. The refrigerated display case of claim 1, wherein the one or more product defrost lights are positioned along a mullion of the refrigerated display case.

8. The refrigerated display case of claim 1, further comprising a plurality of lateral flow barriers positioned within the inner volume of the refrigerated display case, the lateral flow barriers configured to impede a lateral flow of refrigerated air within the refrigerated display case.

9. The refrigerated display case of claim 8, wherein each of the plurality of lateral flow barriers are aligned with one of a plurality of mullions positioned in the refrigerated display case.

10. The refrigerated display case of claim 8, further comprising:

a first sub-compartment defined by at least one mullion, at least one lateral flow barrier, and at least one door; and a second sub-compartment defined by the at least one mullion, the at least one lateral flow barrier, and the at least one door.

11. The refrigerated display case of claim 10, wherein the at least one lateral flow barrier is configured to impede a flow of an ambient air from entering the second sub-compartment from the first sub-compartment when the at least one door is opened.

12. The refrigerated display case of claim 11, wherein the ambient air comprises at least one of a warm air or a moist air.

13. The refrigerated display case of claim 1, wherein the controller is configured to perform operations comprising operating the one or more product defrost lights to melt frost on a surface of the product.

14. The refrigerated display case of claim 13, wherein operating the one or more product defrost lights to melt frost on a surface of the product comprises operating the one or more product defrost lights for a predetermined amount of time to reduce frost on the surface of the product.

15. The refrigerated display case of claim 14, wherein the predetermined amount of time is a maximum of 5 minutes, 10 minutes, or 15 minutes.

16. A refrigerated display case comprising:

a plurality of sidewalls and one or more doors, the plurality of sidewalls and the doors defining an inner volume of the refrigerated display case;

a plurality of shelves positioned within the inner volume of the refrigerated display case, the plurality of shelves fixedly coupled with at least one sidewall of the plurality of sidewalls and are configured to support a product;

a cooling system configured to provide cooling to the inner volume of the refrigerated display case, the cooling system comprising a cooling coil;

one or more product defrost devices, each of the one or more product defrost devices oriented towards a corresponding shelf of the plurality of shelves, and the one or more product defrost devices are configured to emit light outside of a visible spectrum to provide heating to the product to melt frost from, or defrost, a surface of the product;

one or more display lights separate from the one or more product defrost devices, integrated into a lighting structure that comprises the one or more product defrost devices, and oriented towards the corresponding shelf of the plurality of shelves, the one or more display lights configured to emit light within the visible spectrum towards the corresponding shelf;

a door lock configured to transition between a locked state in which a particular door of the one or more doors is prevented from opening and the inner volume is inaccessible and an unlocked state in which the particular door is openable and the inner volume is accessible; and a controller operably coupled with the cooling system, the one or more display lights, the door lock, and the one or more product defrost devices, the controller configured to perform operations comprising:

determining a door status of the particular door;

based on the determined door status, transitioning the door lock to the locked state; and subsequent to the transitioning, activating the one or more product defrost devices while maintaining the inner volume as inaccessible with the door lock in the locked state.

17. The refrigerated display case of claim 16, wherein the product defrost devices are infrared lights configured to emit infrared light energy towards the product to defrost the product.

18. The refrigerated display case of claim 16, wherein the product defrost devices are ultraviolet lights configured to emit ultraviolet light energy towards the product to defrost the product.

19. The refrigerated display case of claim 16, wherein the product defrost devices are ultrasonic devices configured to emit ultrasonic energy towards the product to defrost the product.

20. The refrigerated display case of claim 16, wherein the controller is configured to perform operations comprising:

determining that the one or more product defrost devices have switched from activated to inactive; and based on the determination, transitioning the door lock to the unlocked state.

21. The refrigerated display case of claim 16, wherein the controller is configured to:

operate the cooling system to provide the cooling to the inner volume of the refrigerated display case over a cooling interval;

operate a cooling coil defrost system to defrost the cooling coil over a defrost interval; and operate the one or more product defrost devices to defrost the product over a product defrost interval.

22. The refrigerated display case of claim 21, wherein the controller is configured to activate the one or more product defrost devices a predetermined amount of time after the defrost interval.

23. The refrigerated display case of claim 16, wherein the one or more product defrost devices are positioned along a mullion of the refrigerated display case.

24. A method for defrosting a product of a refrigerated display case, the method comprising:

operating a cooling system to provide cooling to an inner volume of the refrigerated display case over a cooling interval;

operating a cooling coil defrost system to provide defrost heating to a cooling coil of the cooling system over a defrost interval;

obtaining a door status of a door of the refrigerated display case;

based on the obtained door status, operating a door lock of the door to transition the door lock into a locked state in which the door is prevented from opening and the inner volume is inaccessible;

activating, subsequent to operating the door lock, one or more product defrost lights to emit light outside of a visible spectrum to provide product defrost energy to a surface of a product in the refrigerated display case to melt frost from, or defrost, the surface of the product; and operating one or more display lights separate from the one or more product defrost lights and integrated into a lighting structure that comprises the one or more product defrost lights and oriented towards a corresponding shelf of a plurality of shelves to emit light within the visible spectrum towards the corresponding shelf.

25. The method of claim 24, further comprising:

determining that the one or more product defrost lights have switched from activated to inactive; and based on the determination, transitioning the door lock of the door to an unlocked state in which the door is openable and the inner volume is inaccessible.

26. The method of claim 24, wherein the one or more product defrost lights are activated after a predetermined amount of time since the defrost interval has elapsed.

27. The method of claim 24, wherein the one or more product defrost lights are ultraviolet lights configured to provide ultraviolet light energy to the surface of the product to melt or defrost the surface of the product.

28. The method of claim 24, wherein the one or more product defrost lights are infrared lights configured to provide infrared light energy to the surface of the product to melt or defrost the surface of the product.

* * * * *